US005148706A

United States Patent [19]

Masuda et al.

[11] Patent Number: 5,148,706

[45] Date of Patent: Sep. 22, 1992

[54] APPARATUS FOR SELECTING MATTRESS

[75] Inventors: Teruo Masuda, Itsukaichi; Masayasu Morita, Fuchu; Masahiro Matsuzaki, Sayama, all of Japan

[73] Assignee: France Bed Co., Ltd., Tokyo, Japan

[21] Appl. No.: 706,876

[22] Filed: May 29, 1991

[51] Int. Cl.[5] ..... A61B 5/11

[52] U.S. Cl. ..... 73/172; 73/865.3; 128/774

[58] Field of Search ..... 73/172, 862.04; 128/774

[56] References Cited

U.S. PATENT DOCUMENTS

| | | | |
|---|---|---|---|
| 4,669,302 | 6/1987 | Wagner et al. | 73/172 |
| 4,827,763 | 5/1989 | Bourland et al. | 73/172 |
| 5,033,291 | 7/1991 | Podoloff et al. | 73/172 |

FOREIGN PATENT DOCUMENTS

| | | | |
|---|---|---|---|
| 2517008 | 11/1975 | Fed. Rep. of Germany | 73/172 |
| 62-183715 | 8/1987 | Japan . | |

*Primary Examiner*—Daniel M. Yasich

*Attorney, Agent, or Firm*—Frishauf, Holtz, Goodman & Woodward

[57] ABSTRACT

Disclosed is an apparatus for selecting a mattress. The amounts of elastic deformation in a plurality of points of a measuring mattress having a predetermined hardness are electrically detected by pressure sensors. Based on the electric signals generated from the pressure sensors, a first average value in the amounts of deformation in the head portion and the leg portion of the user and a second average value in the amounts of deformation in the other portions of the user are calculated in a control device. First and second straight lines denoting these first and second average values, respectively, are displayed on a display device together with a mark designating the hardness of a mattress adapted to the user. The optimum hardness of the mattress is determined on the basis of the difference in the amount of deformation between the first and second straight lines, so as to enable the user to select a mattress of a hardness adapted to the user.

9 Claims, 9 Drawing Sheets

APPARATUS FOR SELECTING MATTRESS

BACKGROUND OF THE INVENTION

1. Field of the Invention

The present invention relates to an apparatus for selecting a mattress hardness suitable for the physical constitution of the user such as the body weight and the height.

2. Description of the Related Art

In general, a bed consists of a bed frame and a mattress mounted in the bed frame. To obtain a comfortable sleeping condition it is very important for the mattress to have a hardness suitable for the physical constitution of the user such as the body weight and the height. When the user sleeps lying on the mattress with the face upward, it is generally said that a comfortable sleeping can be obtained in the case where the height of the waist portion based on a plane including both the back portion and the hip portion is about half the corresponding height in the standing state. In other wards, if the bending of the spinal column in the sleeping state is moderate, compared with the bending in the standing state, it is possible to ensure a natural sleeping posture in which an unnatural force is not applied to the internal organs.

In the case of using an unduly soft mattress, the back portion and the hip portion of the user lying on the mattress drop unduly deep into the mattress, resulting in a relative projection of the waist portion. In this case, the height noted above becomes considerably greater than that in the standing state. Of course, the bending of the spinal column of the user also becomes greater, with the result that an unnatural force is applied to the internal organs of the user. It follows that the user feels a pain, failing to sleep comfortably.

Generally speaking, it is desirable to use a hard mattress because the dropping of the back portion and the hip portion can be suppressed. If the mattress is unduly hard, however, the body of the user is supported by some parts of the back portion and the hip portion. In this case, the pressure is concentrated on the back portion and the hip portion, resulting in failure to ensure a comfortable sleeping.

Suppose a mattress is selected in view of the hardness thereof alone. In this case, the actual dropping amount of the back portion and the hip portion of the user depends on the physical constitution of the user such as the body weight and the height. It follows that, in selecting a mattress, it is also important to consider the physical constitution of the user such as the body weight and the height in addition to the hardness of the mattress. In other words, it is important to select a mattress suitable for the physical constitution of the user.

Japanese Patent Application No. 61-25329 (corresponding to Japanese Patent Disclosure (KOKAI) No. 62-183715), discloses an apparatus for selecting a mattress suitable for the user. This prior art teaches that, when a user lies on a measuring mattress, arm-like displacement members are swung in accordance with the elastic deformation of the measuring mattress. An interlocking rod, which is connected to each displacement member, is interlocked with the swinging of the displacement member so as to slide in a vertical direction. The upper ends of the interlocking rods are connected to each other by a single string. It follows that the string depicts a graph showing the state of deformation of the measuring mattress on which the user lies.

The deformation state of the measuring mattress depicted by the string permits the user to determine whether the measuring mattress is hard or soft to the user, making it possible for the user to select a mattress of a hardness suitable for the user himself.

In the prior art cited above, however, the elastic deformation of the measuring mattress is mechanically transmitted by the body of displacement and the interlocking rods, resulting in an increase in the number of parts used and in a complex structure of the system. In addition, the parts of the apparatus can be damaged in an early stage of use by abrasion, leading to an erroneous transmission of the elastic deformation of the measuring mattress.

SUMMARY OF THE INVENTION

An object of the present invention is to provide an apparatus for selecting a mattress, in which the amount of elastic deformation in each part of a measuring mattress, when the user lies on the measuring mattress, is electrically detected. The electric signal thus detected enables the user to know the hardness of a mattress suitable for the user himself.

According to the present invention, there is provided an apparatus for selecting a mattress suitable for the physical constitution of the user, comprising:

a measuring mattress having a predetermined hardness, on which the user lies;

detecting means for electrically detecting the loads on a plurality of points of the measuring mattress when the user lies on the measuring mattress;

control means receiving the electric signals generated from said detecting means for calculating a first average value of the amounts of deformation in the head portion and the leg portion of the user and a second average value of the amounts of deformation in portions other than the head portion and the leg portion of the user; and display means for displaying the first average value and the second average value calculated by said control means as a first straight line and a second straight line, respectively, and for displaying a mark which designates the hardness of a mattress suitable for the user, said hardness being determined on the basis of the difference in the amounts of deformation denoted by said straight lines.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
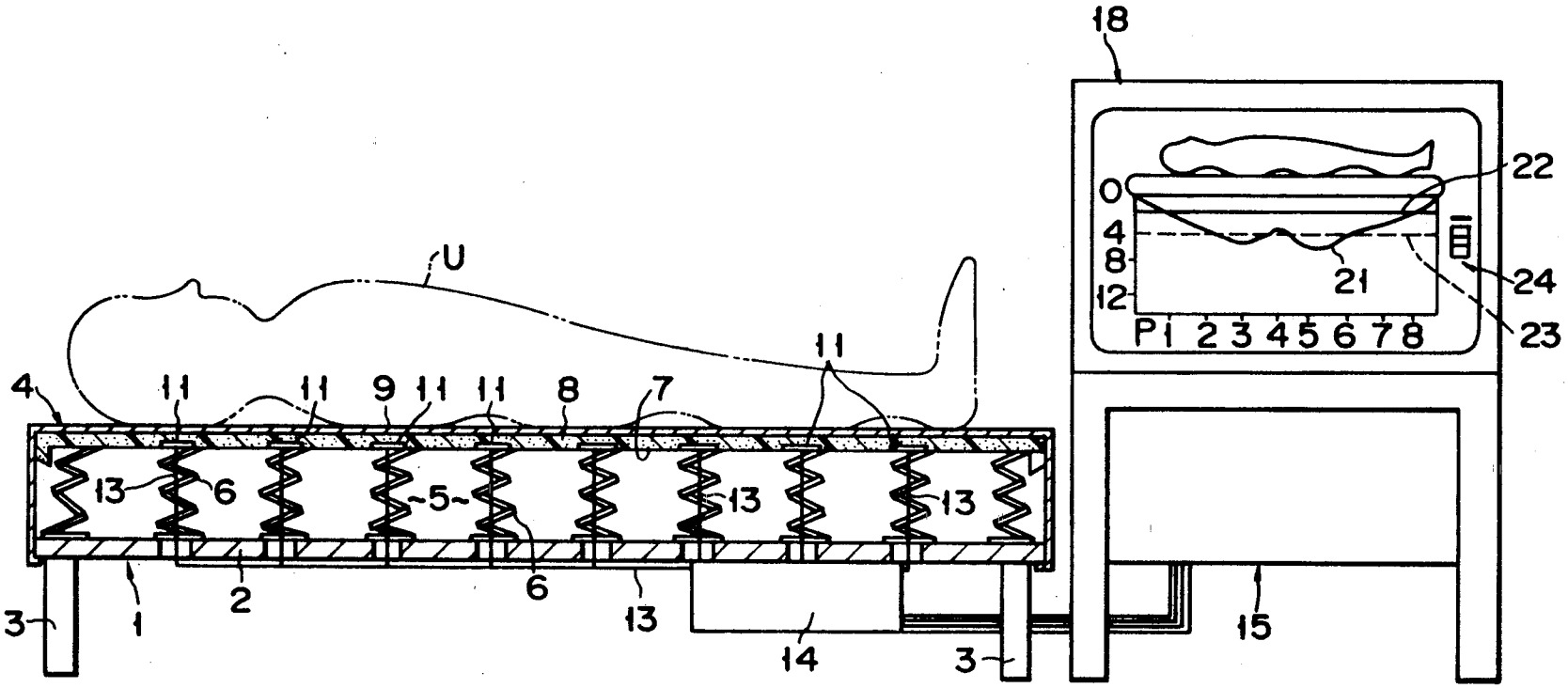
FIG. 1 schematically illustrates an entire apparatus according to a first embodiment of the present invention.

FIGS. 1 to 5 collectively show an apparatus for selecting a mattress according to a first embodiment of the present invention. As shown in FIG. 1, the apparatus comprises a bed frame 1 consisting of a rectangular supporting plate 2 and four legs 3 (two legs being shown in the drawing) serving to hold horizontally the supporting plate 2 at a predetermined height.

A measuring mattress 4, which is disposed on the upper surface of the supporting plate 2, comprises a spring unit 5, i.e., an elastic unit. The spring unit 5 consists of a large number of coil springs 6 arranged to form a matrix on the supporting plate 2. As apparent from the drawing, the coil springs 6 are arranged such that the axes thereof are parallel with each other. The coil spring 6 has a predetermined spring constant or a cushoning property (hardness), i.e., a predetermined amount of elastic deformation relative to the load. It follows that the hardness of the measuring mattress 4 can be rated on the basis of the hardness of the coil spring 6.

A synthetic resin net 7 is disposed to cover the upper surface of the spring unit 5. Also, a sheet-like elastic member 8 such as an urethane foam is disposed on the resin net 7. The upper surface of the elastic member 8 and the periphery of the spring unit 5 are covered with a cover sheet 9. The periphery of the cover sheet 9 is fixed to the lower surface of the supporting plate 2 by, for example, a tacker (not shown).

A pressure sensor 11 acting as a detecting means is mounted on the upper surface of each of the predetermined coil springs 6 arranged to form a column in the longitudinal direction of the supporting plate 2. In the embodiment as shown in FIG. 1, the pressure sensors 11 are mounted on eight coil springs 6. The column of these coil springs 6 is positioned in the central portion of the spring unit 5 in the width direction of the supporting plate 2.

Figure 2:
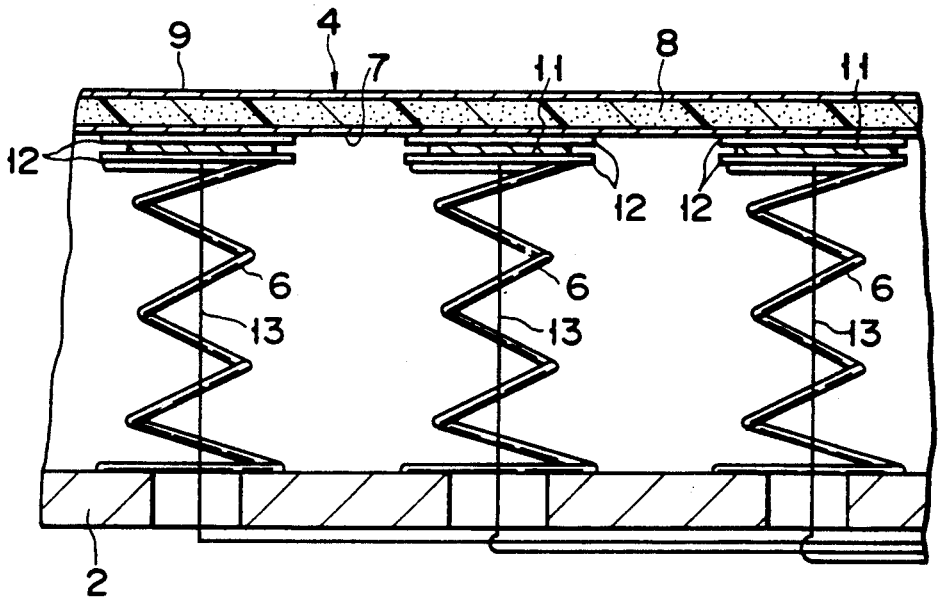
FIG. 2 is a cross sectional view showing in a magnified fashion a part of a measuring mattress included in the apparatus of the present invention.

Each of these pressure sensors 11 is sandwiched between a pair of disk-shaped plates 12, as shown in FIG. 2. The plate 12 is formed of a relatively hard synthetic resin which is unlikely to be elastically deformed by load. These plates 12 permit the load in each part of the user U lying on the measuring mattress 4 to be transmitted to the pressure sensors 11 without fail. Upon receipt of pressure, each pressure sensor 11 generates an electric signal corresponding to the magnitude of the pressure. The pressure sensor 11 may be of any type such as the type of changing the electric resistance, electrostatic capacitance type, electromagnetic induction type and self-dynamo type.

Figure 3:
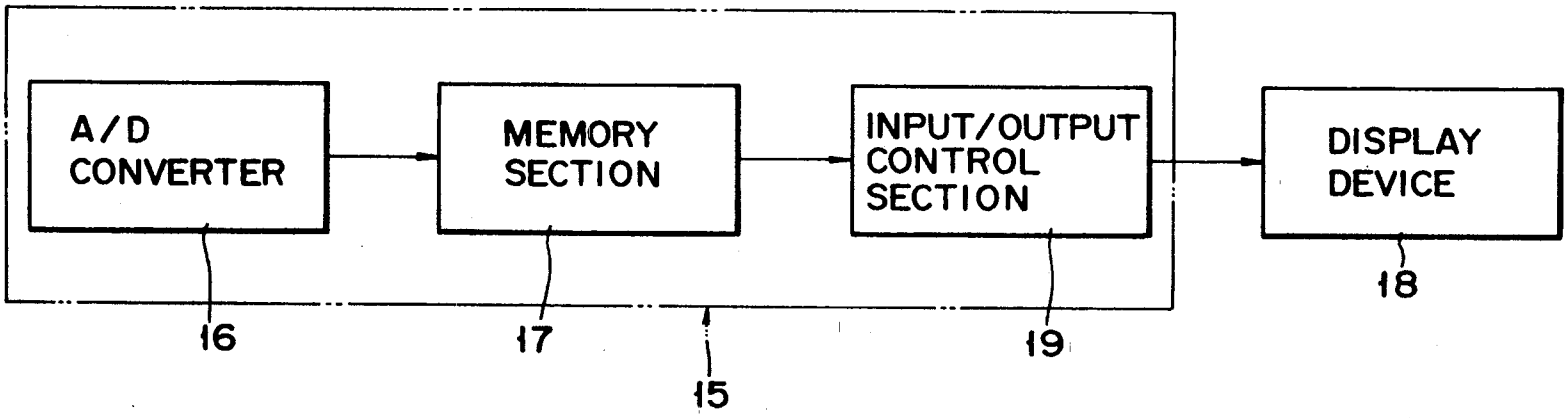
FIG. 3 shows the construction of a control device included in the apparatus of the present invention.

One end of a lead wire 13 is connected to the pressure sensor 11, with the other end being connected via a replay box 14 mounted to the lower surface of the supporting plate 2 to a control device 15 consisting of a personal computer. As shown in FIG. 3, the control device 15 comprises an A/D converter 16 serving to convert the electric signal detected by the pressure sensor 11 into a digital signal, a memory section 17 consisting of a ROM housing a monitor serving to compare the digital signal generated from the A/D converter 16 with a predetermined data or a control program so as to perform a control function, and an input/output control section 19 for performing an input/output of data signal between the memory section 17 and a color CRT display device 18.

Figure 4:
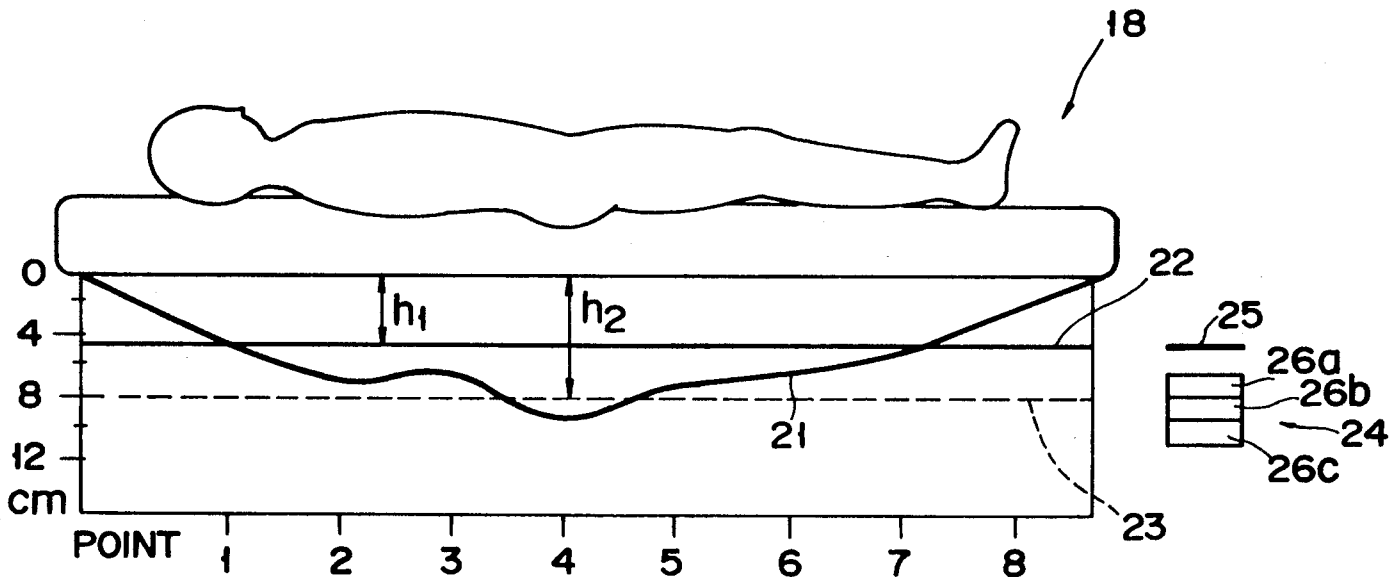
FIG. 4 shows in a magnified fashion a picture image displayed on a display device included in the apparatus of the present invention.

The pressure distribution (amount of elastic deformation) in points 1 to 8 on the measuring mattress 4 detected by the eight pressure sensor 11 is displayed as a curve 21 on the display device 18, as shown in FIG. 4. Also displayed are a first straight line 22 (solid line), a second straight line 23 (broken line), and a mark 24 designating a mattress of a hardness adapted to the user U. The appropriate hardness suitable for the user U is calculated on the basis of the first and second straight lines 22 and 23.

To be more specific, the first straight line 22 denotes an average value h1 in the amounts of elastic deformation in points 1, 6, 7 and 8 corresponding to the head portion and the leg portion of the user U lying on the measuring mattress 4. In short, the average value h1 is:

$$h1=(t1+t6+t7+t8)/4 \quad (1)$$

Where t1, t6, t7 and t8 denote the amounts of elastic deformation in points 1, 6, 7 and 8 respectively.

Likewise, the second straight line 23 denotes an average value h2 in the amounts of elastic deformation in the other points 2, 3, 4 and 5 of the user U lying on the measuring mattress 4. In short, the average value h2 is:

$$h2=(t2+t3+t4+t5)/4 \quad (2)$$

Where t2, t3, t4 and t5 denote the amounts of elastic deformation in points 2, 3, 4 and 5 respectively.

It should be noted that the difference between the average value h1 denoted by the first straight line 22 and the average value h2 denoted by the second straight line 23 represents a difference in the amount of elastic deformation of the measuring mattress between the heavy portion and the light portion of the user U. It has been confirmed that the difference in the average values noted above substantially conforms with the height of the waist portion with respect to the plane including both the back portion and the hip portion of the user lying on the mattress. It follows that, where the difference in the amount of deformation is greater than about the half of the "height" of the waist portion wit respect to the plane including both the back portion and the hip portion of the user U standing upright, the measuring mattress 4 is unduly soft to the user. On the other hand, where the difference noted above is smaller than about the half on the "height" of the waist portion noted above, the measuring mattress 4 is unduly hard to the user.

The mark 25 displayed on the display device 18 consists of a reference line 25 and first to third blocks 26*a* to 26*c* positioned a predetermined distance below the reference line 25. These blocks 26*a* to 26*c* are differently colored. For example, the first block 26*a* is colored blue, the second block 26*b* is colored yellow, and the third block 26*c* is colored red.

Where the reference line 25 of the mark 24 is aligned with the first straight line 22, the distance between the reference line 25 and the second block 26*b* is set such that the second block 26*b* conforms with the second straight line 23 when the difference between the average value h1 and the average value h2 is about half the height of the waist portion with respect to the plane including both the back portion and the hip portion of the user standing upright. In general, the "height" of the hip portion, which gives a comfortable sleeping condition to the user, is about 2 to 3 cm.

Suppose the first block 26*a* is aligned with the second straight line 23. This implies that the amount of elastic deformation of the measuring mattress is unduly small. In other words, the alignment of the first block 26*a* with the second straight line 23 denotes that the measuring mattress 4 is unduly hard to the user. Likewise, the alignment of the third block 26*c* with the second straight line 23 indicates that the measuring mattress is unduly soft to the user.

The colors of the first to third blocks 26*a* to 26*c* represent mattresses of different hardness determined on the basis of the hardness of the measuring mattress 4. To be more specific, the blue of the first block 26*a* indicates a mattress of a hardness higher than that of the measuring mattress 4. The yellow of the second block 26*b* indicates a mattress of a hardness equal to that of the measuring mattress 4. Further, the red of the third block 26*c* indicates a mattress of a hardness lower than that of the measuring mattress 4.

The mark 24 is displayed in advance in the upper right corner portion of the display device 18 shown in each of FIGS. 1 and 4. After the first straight line 22 and the second straight line 23 have been displayed on the display device 18, the reference line 25 of the mark 24 is moved downward to a height aligned with the first straight line 22. In this step, a mattress of a hardness adapted to the user U can be selected by observing which of the blocks 26*a* to 26*c* is aligned with the second straight line 23.

Figure 5:
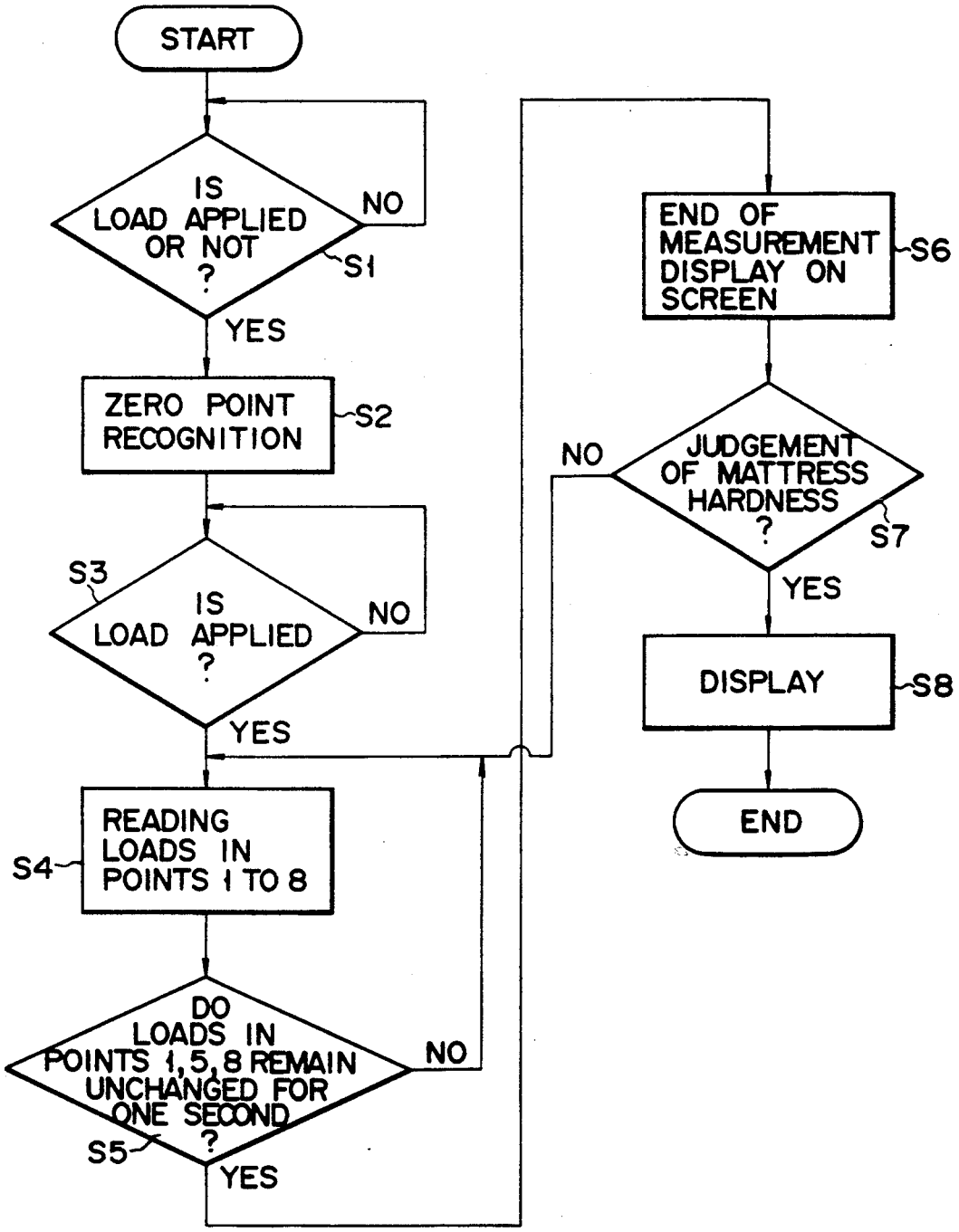
FIG. 5 is a flow chart showing the operation of the apparatus of the present invention.

FIG. 5 shows the operation for selecting a mattress of a hardness adapted to the physical constitution of the user U by using the selecting apparatus of the construction described above. When the selecting apparatus is operated, it is determined in step 1 (S1) whether or not load is applied to the measuring mattress 4. If load is not applied, the zero point of each pressure sensor 11 is recognized in step 2 (S2). Even if the pressure sensors 11 do not coincide with each other in the zero point of the detected pressure, the condition that the user U is not on the measuring mattress 4 is recognized as the zero point of each pressure sensor 11.

After the zero point recognition, the user U lies on the measuring mattress 4 in step 3 (S3). In this step, the load application is discriminated. After the discrimination, the electric signals generated from the pressure sensor 11 are converted within the A/D converter 16 into digital signals and, then, stored in the memory section 17 in step 4 (S4). Then, in step 5 (S5), it is discriminated whether or not points 1, 5, 8 included in the measuring points 1 to 8 remain unchanged for one second. In other words, whether load is concentrated on a part of the measuring mattress or whether the user U is moving on the measuring mattress is discriminated from the conditions in the central portion and the both end portions of the measuring mattress 4.

If "YES", i.e., if the measuring points 1, 5, 8 are found to remain unchanged for one second, the measurement is finished in step 6 (S6) and the results of the measurement are displayed on the display device 18. To be more specific, displayed are the curve 21 denoting the amounts of deformation in the measuring points 1 to 8, which have been detected by the first to eighth pressure sensors 11, the first straight line 22 denoting the average value h1 in the amounts of elastic deformation in the head portion and the leg portion of the user, and the second straight line 23 denoting the average value h2 in the amounts of elastic deformation in the other portions of the user lying on the measuring mattress 4.

After display of the results of the measurement, the mark 24 in the upper right corner of the display device 18 is moved downward in step 7 (S7) until the reference line 25 of the mark 24 is aligned with the first straight line 22. Under this condition, a mattress having a hardness adapted to the physical constitution of the user can be selected by observing which of the first to third blocks 26*a* to 26*c* of the mark 24 is aligned with the second straight line 23. Suppose the second block 26*b*, which is yellow, is aligned with the second straight line 23. This indicates that a mattress of a hardness equal to that of the measuring mattress is adapted to the user U. Where the first block 26*a* is aligned with the second straight line 23, a mattress of a hardness lower than that of the measuring mattress 4 is adapted to the user. Likewise, where the third block 26*c* is aligned with the second straight line 23, a mattress of a hardness higher than that of the measuring mattress 4 is adapted to the user.

The result of step 7 is displayed in step 8 (S8) on the display device 18. The user U is also informed of the result acoustically.

As described above, the apparatus of the present invention enables the user U to select a mattress of a hardness adapted to the user U by observing the degree of difference between the first straight line 22 (average value h1) and the second straight line 23 (average value h2). In the case of selecting a mattress based on the difference between the average values h1 and h2, it is possible to select a mattress of a hardness adapted to the user U regardless of the physical constitution of the user U such as the body weight and the height. It should be noted in this connection that known is a prior art in which the state of elastic deformation obtained from the state of pressure distribution is simply displayed as a graph, and the graph thus displayed is compared with another graph denoting the ideal state of elastic deformation. In this prior art, however, the graph denoting the ideal state of elastic deformation differs depending on the physical constitution of the user such as the body weight and the height, making it impossible to achieve an accurate comparison.

In the present invention, however, a mattress of a hardness adapted to the user U is selected on the basis of the difference between the average values h1 and h2, making it possible to select a mattress of a hardness adapted to the user regardless of the physical constitution of the user.

Figure 6:
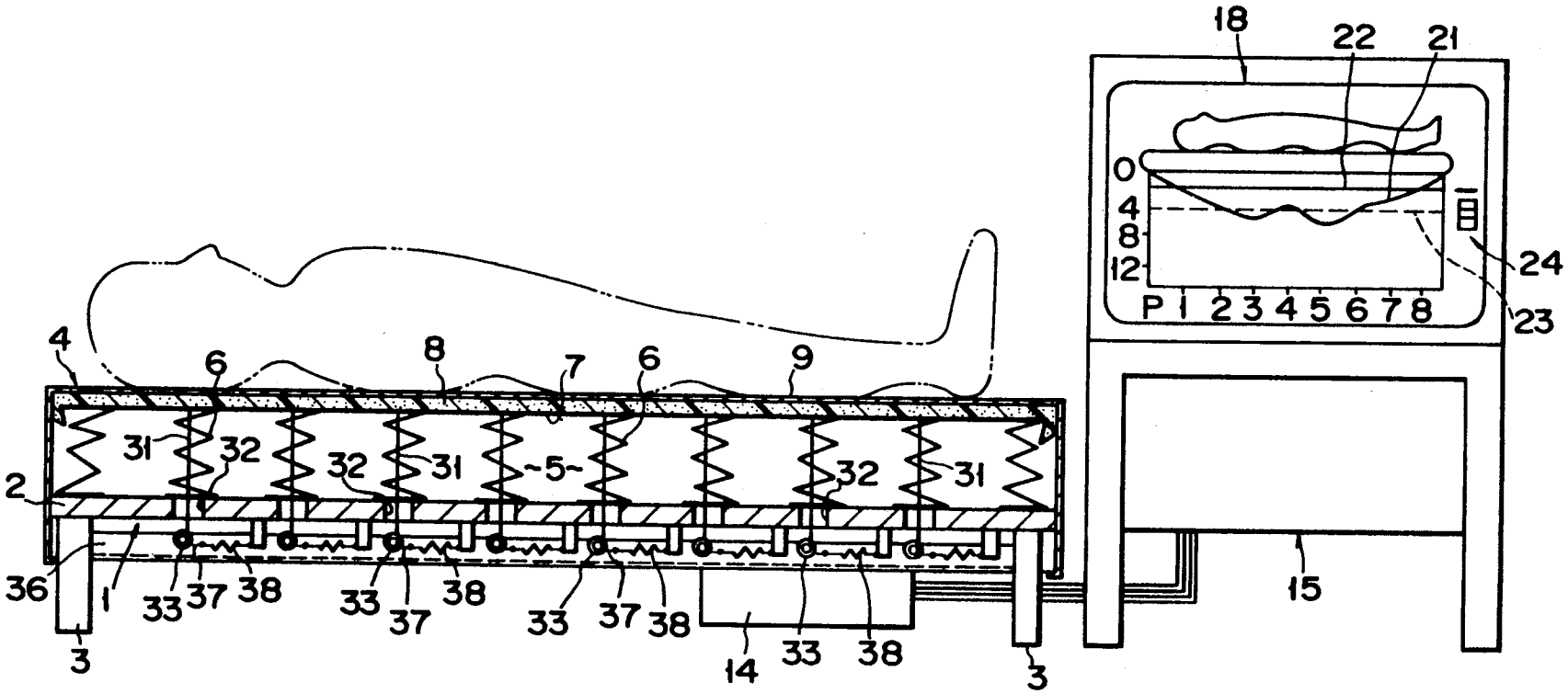
FIG. 6 schematically illustrates an entire apparatus according to a second embodiment of the present invention.
Figure 7:
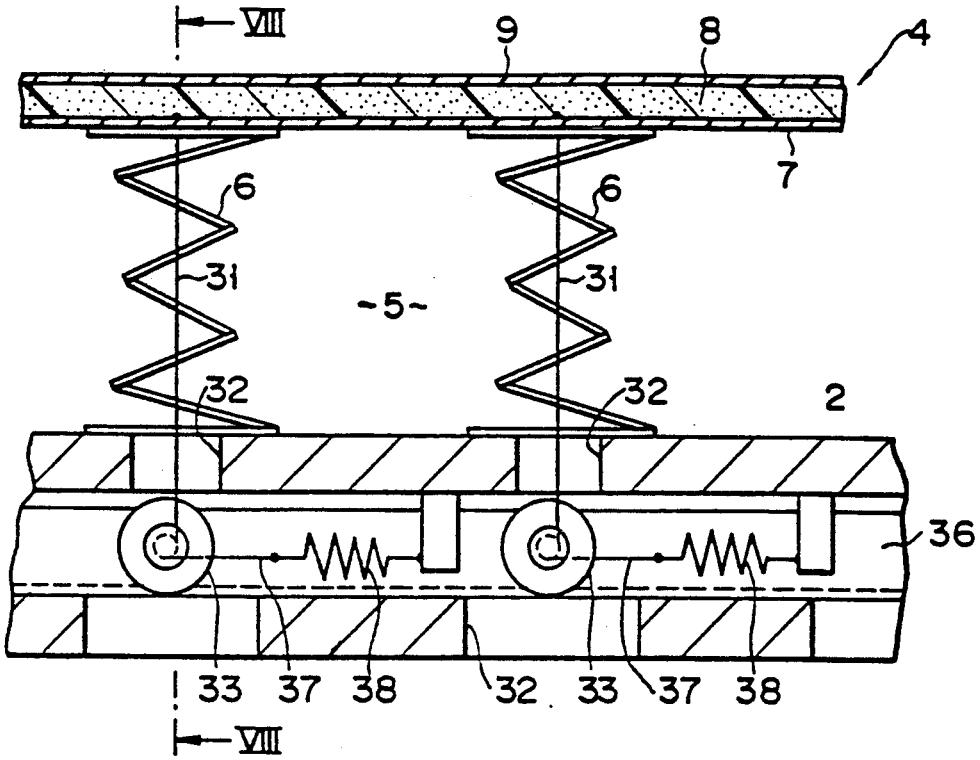
FIG. 7 is a cross sectional view showing in a magnified fashion a part of a measuring mattress included in the apparatus of the present invention.
Figure 8:
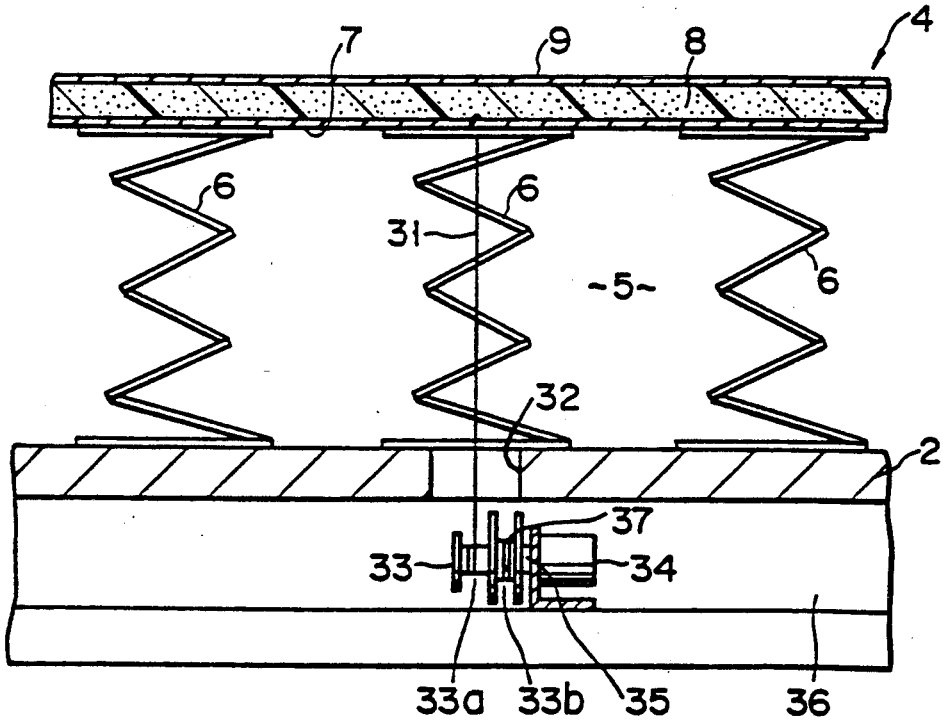
FIG. 8 is a cross sectional view, depicted in a magnified fashion, along the line VIII—VIII of FIG. 7.

FIGS. 6 to 8 collectively show an apparatus according to a second embodiment of the present invention. The second embodiment differs from the first embodiment in the detecting means for detecting the pressure applied to the measuring mattress 4. In the second embodiment, one end of a first string 31 is connected to the upper end of the coil spring 6 positioned below the net 7. The other end portion of the first string 31 extends downward through a hole 32 made in the supporting plate 2 so as to be wound about a first drum 33*a* of a pulley 33 positioned below the supporting plate 2. As shown in FIG. 8, the pulley 33 is rotatably mounted to a control shaft 35 of a variable resistor 34 acting as a detecting means. The variable resistor 34 is mounted to a mounting member 36 extending in the longitudinal direction of the supporting plate 2. The mounting member 36 is positioned in the central portion in the width direction of the supporting plate 2.

The pulley 33 is provided with a second drum 33*b* to which is fixed one end of a second string 37. The other end of the second string 37 is connected to one end of a bias spring 38. The other end of the bias spring 38 is connected to the mounting member 36. The spring force of the bias spring 38 is lower than that of the coil spring 6 included in the spring unit 5. It follows that, even if the pulling force of the bias spring 38 is exerted to the pulley 33 via the second string 37, the pulley 33 is not rotated. If the coil spring 6 is compressed, however, the first string 31 is loosened, with the result that the second string 37 is pulled by the bias spring 38 so as to rotate the pulley 33.

Rotation of the pulley 33 is interlocked with the rotation of the control shaft 35 of the variable resistor 34 so as to change the resistance value of the variable resistor 34. An electric signal denoting the change in the resistance value of each of the variable resistors 34 is supplied to the control device 15. As in the first embodiment described previously, the control device 15 comprises an A/D converter 16 serving to convert an analog signal denoting the resistance value of the variable resistor 34 to a digital signal, a memory section 17 and an input/output control section 19.

If the user U lies on the measuring mattress 4 included in the apparatus of the second embodiment, the coil springs 6 of the spring unit 5 are compressed, i.e., elastically deformed. The amount of elastic deformation in each coil spring 6 is detected by the variable resistor 34, and the signal denoting the detected amount of deformation is supplied from the variable resistor 34 to the control device 15. It should be noted that the first straight line 22 and the second straight line 23 are displayed on the display device 18, as in the first embodiment, making it possible for the user U to select a mattress of a hardness adapted to the user U himself by comparing these straight lines with the mark 24, which is also displayed on the display device 18.

Figure 9:
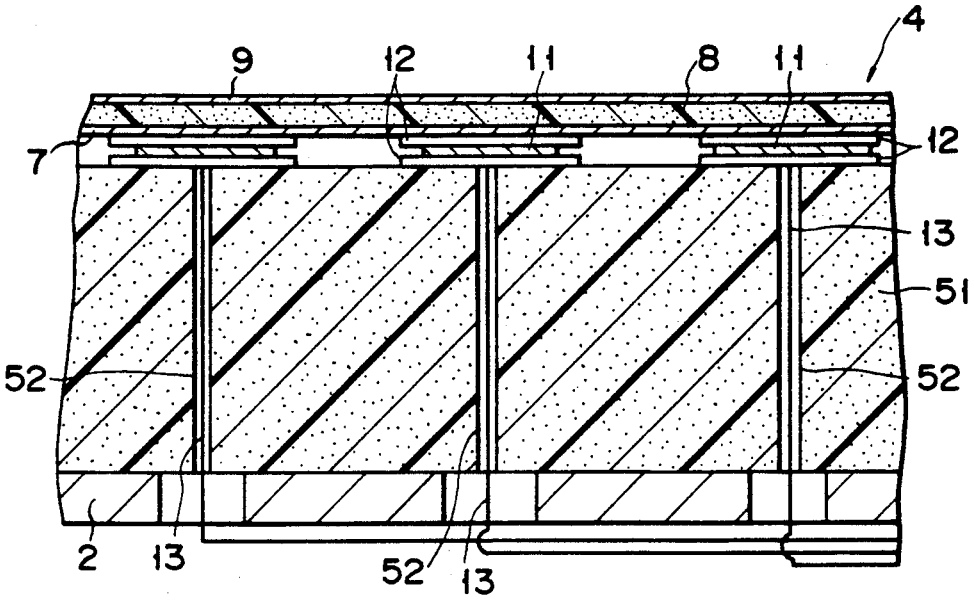
FIG. 9 is a cross sectional view showing in a magnified fashion a part of a measuring mattress included in the apparatus according to a third embodiment of the present invention.

FIG. 9 shows an apparatus according to a third embodiment of the present invention. In this embodiment, a cushioning member 51 prepared by forming an urethane foam into a rectangular plate shape is used as an elastic unit in place of the spring unit 5 used in the first embodiment. It is possible to control as desired the hardness of the cushioning member 51 by changing appropriately the foaming rate of the urethane foam. Also, a pressure sensor 11 between two plates 12 is used as a detecting means, as in the first embodiment. Of course, a plurality of pressure sensors 11 are included in the apparatus of the third embodiment. Each of the pressure sensors 11 is mounted at a predetermined position on the upper surface of the cushioning member 51. Further, the lead wire 13 connected at one end to the pressure sensor 11 extends through a hole 52 made in the thickness direction of the cushioning member 51 so as to reach the relay box 14.

Figure 10:
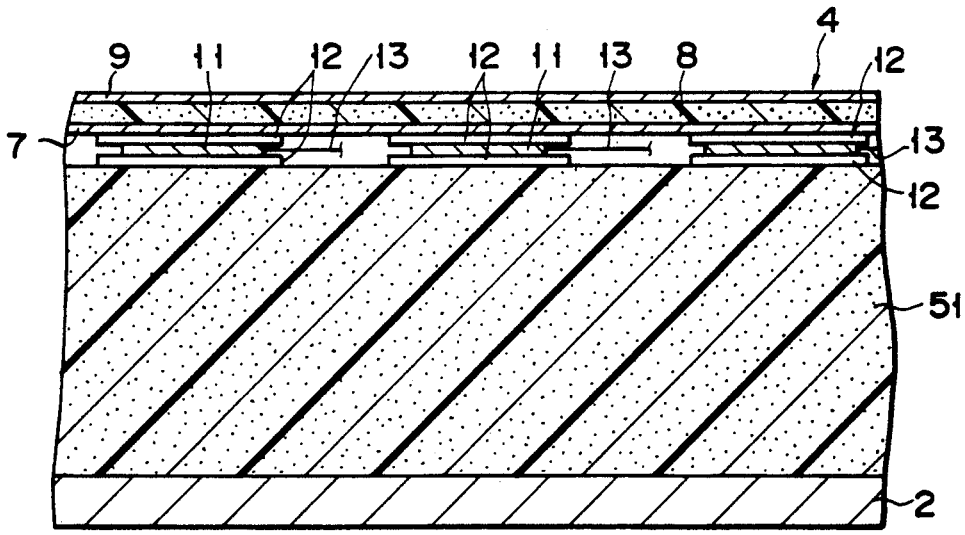
FIG. 10 is a cross sectional view showing in a magnified fashion a part of a measuring mattress included in the apparatus according to a fourth embodiment of the present invention.

FIG. 10 shows an apparatus according to a fourth embodiment of the present invention. The fourth embodiment is substantially equal in construction to the third embodiment shown in FIG. 9, except that the hole 52 included in the third embodiment is not made in the cushioning member 51 in the fourth embodiment shown in FIG. 10. Also, the lead wire 13 connected at one end to the pressure sensor 11 extends through the clearance between the upper surface of the cushioning member 51 and the net 7 so as to reach the relay box 14.

Figure 11:
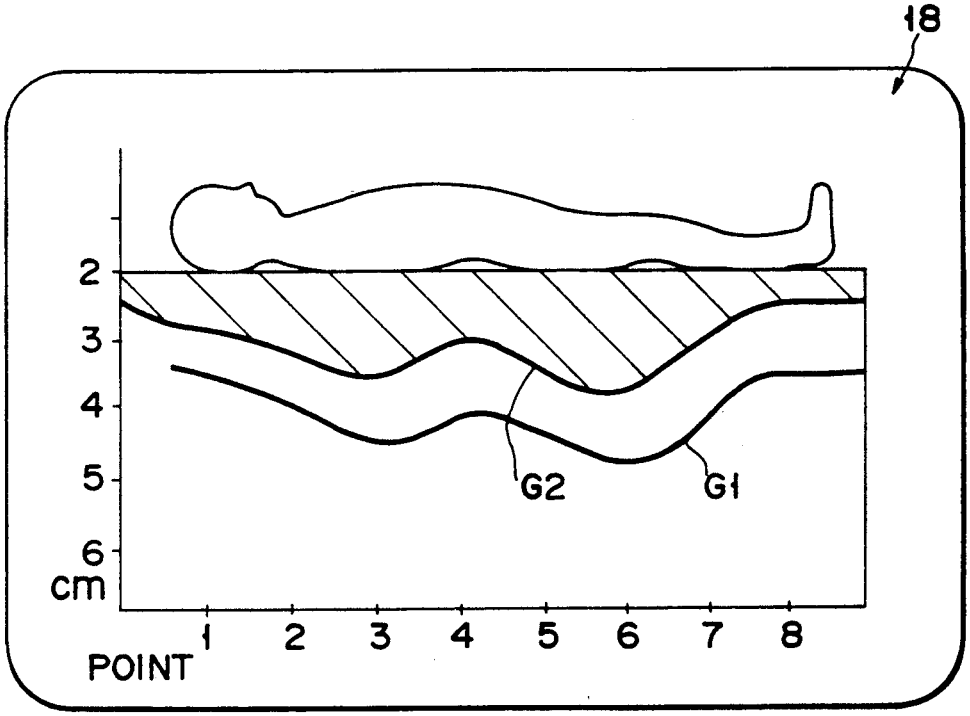
FIG. 11 shows in a magnified fashion a picture image displayed on a display device included in the apparatus according to a fifth embodiment of the present invention.

FIG. 11 shows an apparatus according to a fifth embodiment of the present invention. The fifth embodiment differs from the first embodiment in the manner of selecting a mattress adapted to the physical constitution of the user U. In the fifth embodiment, a first curve G1 reflecting the distribution of pressures on the measuring mattress 4, which are detected by the eight pressure sensors 11 as shown in FIG. 1. The pressure sensors shown in FIG. 1 are mounted on eight coil springs 6. The column of these coil springs 6 is positioned in the central portion of the spring coil 5 of FIG. 1 in the width direction of the supporting plate 2. The distribution of pressures at the eight sensors are displayed on the display device 18 of FIG. 11. Also displayed as shown in in FIG. 11 is a second curve G2 denoting the ideal state of elastic deformation of the measuring mattress 4, which is stored in advance in the memory section 17 of the control device 15. Needless to say, the second curve G2 denotes the state of elastic deformation, in which the height of the waist portion of the user U lying on the mattress with respect to the plane including both the head portion and the hip portion is about half the height of the user standing upright, e.g., 2 to 3 cm higher than the height of the user standing upright.

The amount of elastic deformation (cm) is plotted on the ordinate of the display device 18, with the positions of the eight coil springs 6 being plotted on the abscissa. It follows that the amount elastic deformation in each point of the measuring mattress 4 can be promptly recognized from the first curve G1 displayed on the display device 18. Naturally, it is possible to select a mattress of a hardness adapted to the user U by comparing the first curve G1 and the second curve G2. For example, where the first curve G1 is positioned lower than the second curve G2, as shown in FIG. 11, it is determined that the actual amount of deformation of the measuring mattress 4 is greater than the ideal amount of deformation. In this case, it is necessary for the user U to select a mattress of a hardness higher than that of the measuring mattress 4. On the other hand, where the first curve G1 is positioned higher than the second curve G2, it is determined that the actual amount of deformation of the measuring mattress 4 is smaller than the ideal amount of deformation. In this case, it is necessary for the user to select a mattress of a hardness lower than that of the measuring mattress, 4.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An apparatus for selecting a mattress which will be suitable for the anatomy of a user, comprising:

a measuring mattress having a predetermined hardness, on which the user lies;

detecting means for detecting a load on each of a plurality of points of the measuring mattress when the user lies on the measuring mattress;

said detecting means including means for generating a detection signal indicating the load at each of the plurality of points, the load at each of the plurality of points deforming the measuring mattress by an amount determined by the actual load at each respective point;

control means for receiving the detection signal generated by said detecting means and for calculating a first average value that represents a plurality of deformations in the measuring mattress at a head portion and a leg portion of the user, said control means further calculating a second average value that represents a plurality of deformations in the measuring mattress at a plurality of other portions of the user excluding the head portion and the leg portion of the user; and display means for displaying the first average value and the second average value calculated by said control means as a first straight line and a second straight line, respectively, said display means further displaying a mark which designates a hardness of a mattress suitable for the user, said hardness being determined on the basis of a comparison in the amounts of deformation represented by the first and second straight lines.

2. The apparatus of claim 1, wherein said detecting means comprises a plurality of pressure sensors for detecting the load applied to each of said plurality of points, each of said loads being applied to said plurality of points through an upper surface of the measuring mattress.

3. The apparatus of claim 1, wherein each pressure sensor is sandwiched between a first and a second hard plate that are not deformed by each of the loads applied to the upper surface of the measuring mattress.

4. The apparatus of claim 1, wherein said detecting means comprises a plurality of variable resistors respectively having an electrical resistance value that changes when the measuring mattress is deformed by the loads applied thereto, said electrical resistance value of each variable resistor being changed in accordance with an actual amount of deformation at a position where each variable resistor is positioned.

5. The apparatus of claim 4, wherein each of said variable resistors comprises:

a control shaft that is rotatable so as to change the resistance value of the variable resistor;

a pulley mounted to said control shaft; and a spring for rotating the pulley when the measuring mattress is deformed, in accordance with the load applied thereto;

said pulley being rotated in accordance with the amount of deformation of the measuring mattress.

6. The apparatus of claim 1, wherein:

said measuring mattress comprises an elastic unit which is elastically deformed upon application of a load, and a covering sheet covering the elastic unit.

7. The apparatus of claim 6, wherein said elastic unit comprises a spring unit having a plurality of coil springs, each coil spring respectively having an axis, the axes of the coil springs being positioned to be substantially in parallel with each other.

8. The apparatus of claim 6, wherein said elastic unit comprises an urethane foam.

9. An apparatus for selecting a mattress which will be suitable for the anatomy of a user, comprising:

a measuring mattress having a predetermined hardness, on which the user lies;

detecting means for detecting a load on each of a plurality of points of the measuring mattress when the user lies on the measuring mattress;

said detecting means generating a detection signal indicating the load at each of the plurality of points;

control means for receiving the detection signal generated by said detecting means and for calculating a first curve representing an actual load distribution on the measuring mattress when the user lies on the mattress, said control means further including means for storing a second curve representing a predetermined ideal load distribution on the measuring mattress and means for comparing the first and second curves; and display means for displaying said first and second curves and for indicating a hardness of a mattress adapted to the specific anatomy of the user based upon the comparison of said first and second curves.

* * * * *